US010266290B2

(12) United States Patent
Keller

(10) Patent No.: US 10,266,290 B2
(45) Date of Patent: Apr. 23, 2019

(54) METHOD FOR PRODUCING COLLECTIONS FROM A PLURALITY OF DIFFERENT PRINTED PRODUCTS AND DEVICE FOR PERFORMING THE METHOD

(71) Applicant: Alex Keller, Rapperswil (CH)

(72) Inventor: Alex Keller, Rapperswil (CH)

(73) Assignee: FERAG AG, Hinwil (CH)

( * ) Notice: Subject to any disclaimer, the term of this patent is extended or adjusted under 35 U.S.C. 154(b) by 608 days.

(21) Appl. No.: 14/711,480

(22) Filed: May 13, 2015

(65) Prior Publication Data

US 2015/0336698 A1 Nov. 26, 2015

(30) Foreign Application Priority Data

May 20, 2014 (CH) ..... 76614

(51) Int. Cl.
*B42C 1/10* (2006.01)
*B43M 3/02* (2006.01)
(Continued)

(52) U.S. Cl.
CPC ..... *B65B 25/14* (2013.01); *B42C 1/10* (2013.01); *B42C 19/02* (2013.01); *B42C 19/08* (2013.01);
(Continued)

(58) Field of Classification Search
CPC ..... B65B 11/00; B65B 11/004; B65B 11/06; B65B 11/08; B65B 11/10; B65B 25/14; B65B 25/145; B65B 35/50; B65B 49/00; B65B 49/08; B65B 49/12; B65B 49/14
USPC ..... 53/397, 447, 460, 461, 462, 465, 540, 53/569, 580, 582, 590, 593, 203, 209, 53/210
See application file for complete search history.

(56) References Cited

U.S. PATENT DOCUMENTS 2,206,868 A * 7/1940 Morgan ..... B41F 13/56 270/5.01
2,994,998 A * 8/1961 Zuercher ..... B65B 27/08 271/11
(Continued)

FOREIGN PATENT DOCUMENTS

CA 2295358 A1 * 7/2000 ..... B65B 5/024
DE 42 07 725 A1 9/1993
(Continued)

OTHER PUBLICATIONS

PrintHut.co.uk®, https://www.youtube.com/watch?v=1CdAGQH_AkM, "A4 Presentation Folder Pirnting at PrintHut.co.uk®," Published Jan. 7, 2013 (1 page).

*Primary Examiner* — Stephen F. Gerrity
(74) *Attorney, Agent, or Firm* — Pauley Erickson & Kottis

(57) ABSTRACT

The invention relates to a method for producing collections (15) from a plurality of N (N=2, 3, 4, . . . ) different printed products (11*a-d*), which collections (15) each comprise a stack (13) of printed products (11*a-c*), which stack is packed in a packaging element (11*d*) wrapped around the stack (13). A solution that does not require additional material use includes the following steps: providing the N printed products (11*a-d*): forming an intermediate stack (13) from N−x (x=1, 2, 3, . . . ) of the N printed products (10*a-d*); providing the x remaining printed products as a packaging element (11*d*); and wrapping the intermediate stack (13) in the packaging element (11*d*).

21 Claims, 5 Drawing Sheets

(51) Int. Cl.

| | |
|---|---|
| ***B43M 3/04*** | (2006.01) |
| ***B42C 19/02*** | (2006.01) |
| ***B42C 19/08*** | (2006.01) |
| ***B65B 25/14*** | (2006.01) |
| ***B65H 45/12*** | (2006.01) |
| ***B65H 39/075*** | (2006.01) |

(52) U.S. Cl.

CPC ..... *B43M 3/02* (2013.01); *B43M 3/045* (2013.01); *B65H 39/075* (2013.01); *B65H 45/12* (2013.01); *B65H 2301/4474* (2013.01); *B65H 2301/51212* (2013.01); *B65H 2404/1151* (2013.01); *B65H 2404/62* (2013.01); *B65H 2404/693* (2013.01); *B65H 2701/18262* (2013.01); *B65H 2701/18264* (2013.01); *B65H 2701/1932* (2013.01)

(56) References Cited

U.S. PATENT DOCUMENTS 3,059,391 A 10/1962 Yolks et al.
3,621,634 A * 11/1971 Freakes ..... B65B 49/12 53/377.2
3,669,008 A 6/1972 Reist
4,071,997 A * 2/1978 Gunther, Jr. et al. ..... B43M 5/045 493/199
4,179,111 A 12/1979 Gunther, Jr. et al.
4,299,073 A 11/1981 Golicz et al.
4,464,878 A * 8/1984 Golicz et al. ..... B31B 70/00 229/68.1
4,694,631 A 9/1987 Gunther, Jr.
4,733,856 A * 3/1988 Gunther, Jr. ..... B07C 1/00 270/1.02
4,787,192 A * 11/1988 Gunther, Jr. ..... B43M 3/04 271/110
4,939,888 A 7/1990 Katz et al.
5,103,617 A * 4/1992 Sjogren et al. ..... B65B 11/08 53/131.5
5,636,499 A * 6/1997 Kramps et al. ..... B65B 25/145 53/116
5,794,409 A * 8/1998 Akridge et al. ..... B65D 27/00 493/216
6,095,510 A * 8/2000 Jaeger ..... B42B 4/00 270/37
6,386,771 B2 5/2002 Haller
6,558,054 B2 5/2003 Haller
6,865,864 B2 * 3/2005 Katz ..... B41F 13/54 493/216
8,544,242 B2 10/2013 Munneke
2005/0137743 A1 * 6/2005 Mockli ..... B65H 39/02 700/219
2006/0196374 A1 * 9/2006 Stemmle et al. ..... B31B 70/00 101/212
2009/0194930 A1 8/2009 Stauber
2009/0282783 A1 * 11/2009 Maaranen ..... B43M 5/042 53/411
2010/0139218 A1 * 6/2010 Jorgensen ..... B65B 11/10 53/461
2011/0029126 A1 2/2011 Van Gorp et al.
2011/0098169 A1 4/2011 Grunder et al.
2011/0121064 A1 * 5/2011 Van Gorp et al. ..... B42D 5/026 229/305
2012/0096810 A1 4/2012 Heisel et al.
2013/0104498 A1 * 5/2013 Naitou ..... B65B 11/48 53/206
2016/0207649 A1 7/2016 Meyerhans et al.

FOREIGN PATENT DOCUMENTS

DE 100 15 485 A1 10/2001
DE 10 2009 049 2 6/2011
EP 0 515 320 A1 11/1992
EP 0 629 551 A1 12/1994
EP 0 671 326 A1 9/1995
EP 0 952 006 A2 10/1999
EP 1 770 014 A2 4/2007
EP 2 444 325 A1 4/2012
EP 2 465 699 A2 6/2012
EP 2 121 451 B1 4/2013
JP H0977359 A 3/1997
JP 2002003075 A 1/2002
JP 2007334424 A 12/2007
WO WO 03/008273 A1 1/2003
WO WO 2008/000099 A1 1/2008
WO WO 2008/074325 A1 6/2008
WO WO 2010/051651 A1 5/2010
WO WO 2011/014968 A1 2/2011
WO WO 2012/084464 A2 6/2012
WO WO 2012084494 A2 * 6/2012 ..... B42C 9/0056
WO WO 2013/023315 A1 2/2013

* cited by examiner

METHOD FOR PRODUCING COLLECTIONS FROM A PLURALITY OF DIFFERENT PRINTED PRODUCTS AND DEVICE FOR PERFORMING THE METHOD

BACKGROUND OF THE INVENTION

Field of the Invention

The present invention concerns the field of the further processing of printed products. The present invention relates to a method for producing collections from a plurality of N (N=2, 3, 4, . . . ) different printed products, the collections each including a stack of printed products which is packed in a packaging element wrapped around the stack. It also relates to a device for performing the method.

Discussion of Related Art

Activities in which advertising pamphlets, brochures, flyers, printed sheets, and the like, which otherwise were often enclosed (inserted) in a newspaper as enclosures for advertising purposes, are collected from several advertisers in order to make a plurality of collections therefrom, which contain a printed product from a plurality of advertisers and are delivered and distributed to the recipients, e.g., households, in the form of a small stack, have long been known under the keyword "direct mailing."

In order to be able to better handle the individual stack-like collections of printed products during the transport and distribution, it is advantageous to take measures to hold together the individual stacks.

From the prior art, it is known that, if one of the printed products is folded, this printed product can be opened and the remaining printed products can be inserted into the opened printed product. However, the insertion of the printed products requires a considerable amount of equipment, which results in corresponding costs.

But holding the collection of printed products together by placing an adhesive or non-adhesive strip laterally around an edge of the collection is also conceivable. Such a technology is known, for example, from WO 2012/084464 A2 or WO 2012/084494 A2 of the applicant. It requires additional expense because of the provision of the strips.

Furthermore, it has already been suggested to connect the printed products of such a collection to each other by applying adhesive points. An example of this is described in the publication EP 2 465 699 A2 of the applicant. In this case also, the application of the adhesive points means an additional use of material, which leads to additional costs in the case of large quantities.

The same also applies to suggestions according to the publication EP 2 121 451 B1 to wrap the stack of the printed products in a special packaging sheet.

The publication EP 0 671 326 A1, which describes a general method for wrapping covering elements around groups of printed products, states in regard to the type of the covering elements only that a wide variety of covering materials is possible.

A disadvantage of all known methods and devices is that they require specific additional materials, which must be stocked and provided in order to be applied to the collections.

SUMMARY OF THE INVENTION

Therefore, a problem addressed by the invention is that of creating a method that does not require additional materials and can be easily performed with limited equipment.

A further problem addressed by the invention is that of specifying a device by means of which such a method can be performed.

These and other problems are solved by the features of a method for producing collections from a plurality of N (N=2, 3, 4, . . . ) different printed products, and a device for performing the method. The invention proceeds from a method for producing collections from a plurality of N (N=2, 3, 4, . . . ) different printed products, which collections each comprise a stack of printed products, which stack is packed in a packaging element wrapped around the stack. The invention includes the following steps:

Providing the N printed products;

Forming an intermediate stack from N−x (x=1, 2, 3, . . . ) of the N printed products;

Providing the x remaining printed products as a packaging element;

Wrapping the intermediate stack in the packaging element.

According to one embodiment of the method according to the invention, x=1.

Another embodiment of the method according to the invention is characterized in that the packaging element is laid onto a substratum, that the intermediate stack is laid onto the packaging element in such a way that only a partial area of the packaging element is covered by the intermediate stack, and that the packaging element is wrapped around the intermediate stack by means of the remaining area.

In particular, in order to wrap the packaging element around the intermediate stack, the remaining area of the packaging element is bent upward approximately at a right angle in a first step and the part of the packaging element bent upward is bent back over the intermediate stack in a second step.

Another embodiment of the method according to the invention is characterized in that the intermediate stack is laid onto a substratum, the packaging element is laid onto the intermediate stack in such a way that the packaging element covers the intermediate stack only by means of a partial area, and that the packaging element is wrapped around the intermediate stack by means of the remaining area.

In particular, in order to wrap the packaging element around the intermediate stack, the remaining area of the packaging element is bent downward approximately at a right angle in a first step and the part of the packaging element bent downward is bent back under the intermediate stack in a second step.

According to another embodiment, the unit including the intermediate stack and the packaging element is moved through a wrapping device in order to bend the packaging element.

A further embodiment is characterized in that movable elements, which are rotated about an axis of rotation oriented transversely to the movement direction of the unit including the intermediate stack and the packaging element, are used to bend the packaging element in the wrapping device.

Another embodiment is characterized in that, after the packaging element has been bent, the bent part of the packaging element is bent back and laid against the intermediate stack by laying the unit including the intermediate stack and the packaging element onto a conveyor belt.

A further embodiment is characterized in that some of the printed products have a fold or a bond, that the printed products having a fold or bond are laid one on top of the other during the formation of the intermediate stack in such a way that the folds or bonds form a common edge of the intermediate stack, and that the intermediate stack is wrapped in the packaging element by means of the common edge.

Finally, it is advantageous if the packaging elements are grooved before the intermediate stack is wrapped.

The device according to the invention for performing the method according to the invention is characterized in that the device comprises a packing device, in which the packaging element lying partially on or below the intermediate stack is wrapped around the intermediate stack.

One embodiment of the device according to the invention is characterized in that the packing device comprises a wrapping device and means for moving the unit including the intermediate stack and the packaging element through the wrapping device.

A further embodiment is characterized in that the means for moving the unit including the intermediate stack and the packaging element through are designed as conveyor segments or conveyor belts lying in a plane, between which a conveying gap is left clear.

Another embodiment is characterized in that the wrapping device comprises movable elements, which reach into the conveying path of the unit including the intermediate stack and the packaging element in the conveying gap. The packaging element can be an individual sheet, a folded product, a four-page document, an eight-page document, stapled, adhesively bonded, or formed in a similar way.

In particular, the movable elements comprise a brush roller bearing bristles, which brush roller is arranged in the conveying gap and can be rotated about an axis of rotation oriented transversely to the conveying direction.

In particular, the movable elements can also comprise rod-shaped entraining elements, which can be moved through the conveying gap while rotating about a specified axis of rotation.

In particular, the axis of rotation can be oriented transversely to the conveying direction and the entraining elements can perform an oscillatory motion parallel to this axis of rotation at the same time as the rotational motion about this axis of rotation, which oscillatory motion occurs between a first extreme position, in which the entraining elements protrude into the conveying path of the unit including the intermediate stack and the packaging element, and a second extreme position, in which the entraining elements are outside of the conveying path of the unit including the intermediate stack and the packaging element.

Another embodiment is characterized in that the rod-shaped entraining elements are arranged on opposite sides of the conveying path of the unit including the intermediate stack and the packaging element in a mirror-symmetric arrangement.

A further embodiment is characterized in that, in order to produce the superposed rotational motion and oscillatory motion, the rod-shaped entraining elements are fastened in a concentric circle to rotary disks arranged at an angle.

Alternatively thereto, the superposed rotational motion and oscillatory motion of the entraining elements can be produced by separate mechanical means.

According to another embodiment, means for feeding the packaging elements to the wrapping device are provided.

In particular, the feeding means comprise a grooving device for grooving the fed packaging elements.

BRIEF DESCRIPTION OF THE DRAWINGS

The invention should be explained in more detail on the basis of embodiment examples in connection with the drawing.

DESCRIPTION OF PREFERRED EMBODIMENTS

Figure 1A:
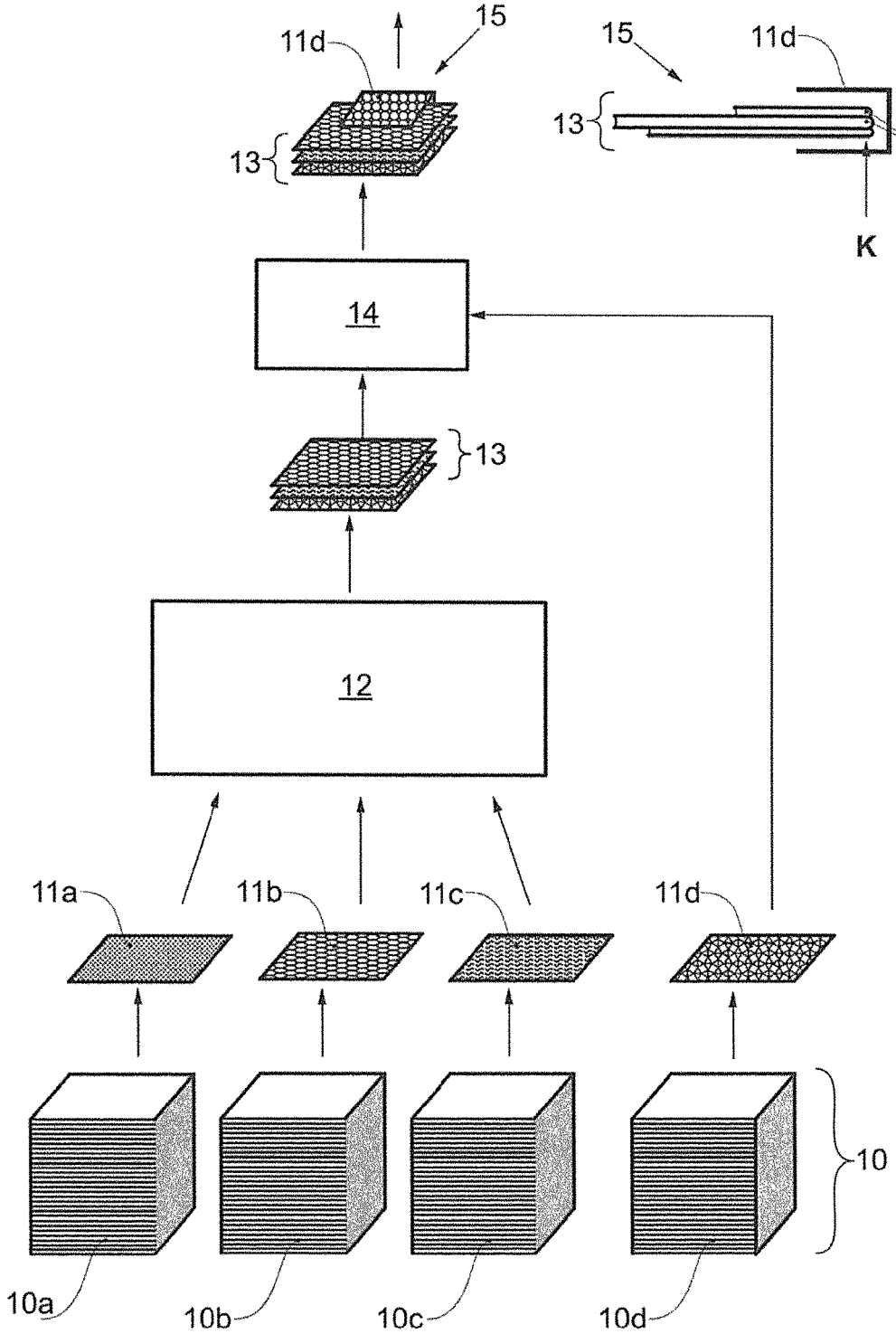
FIG. 1*a* shows an embodiment example of the method according to the invention in a schematic representation.
Figure 1B:
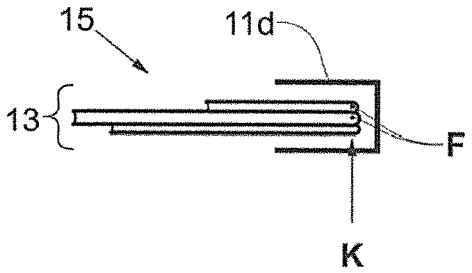
FIG. 1*b* shows an example of a collection of folded printed products in a side view.

FIG. 1 shows a method according to an embodiment example of the invention in a schematic representation. The example shown proceeds from four individual printed products 11*a* to 11*d*, which are, for example, pamphlets, advertising brochures, or the like having a fold or a bond. A corresponding supply stack (a pallet or the like) 10*a* to 10*d* of each printed product having a plurality of individual copies is present and provided.

A printed product, in this case the printed product 11*d* and the associated supply stack 10*d*, is then selected from the various printed products 11*a* to 11*d* or supply stacks 10*a* to 10*d* and kept ready for packing. In the general case, of the N (N=2, 3, 4, . . . ) different printed products, one is kept ready and the remaining N−1 printed products are packed by means of this one selected printed product. However, it is also conceivable that more than one printed product, in general x (x>1) printed products, are selected and that the remaining N−x printed products are packed by means of the x selected printed products.

The N−1 or N−x remaining printed products, in the present example of FIG. 1 the three printed products 11*a*, 11*b*, and 11*c*, are fed to a collecting device 12, which merges three different printed products from the three different supply stacks into an intermediate stack 13 by means of feeding devices and transfers the three different printed products to a following packing device 14. Printed products 11*d* are fed from the supply stack 10*d* of the selected printed product 11*d* to the packing device 14 in a different way and are used individually to pack or wrap the intermediate stack 13, so that collections 15 in which the intermediate stack 13 is wrapped in a printed product 11*d* wrapped around the edge are output at the outlet of the packing device 14. In this way, all printed products are present and wrapped in the collection 15 once without additional material being required for the packing and having to be provided.

If one of the provided printed products 11*a* to 11*d* is especially suitable as a packing material because of its qualities (format, material, strength, flexibility, etc.), it is advantageous to select this printed product for packing or wrapping the intermediate stack 13 therein. In particular, the optical design of the selected printed product can be adapted to its specific use in advance, so that information (text, images, etc.) on the printed product can be easily recognized even if the printed product is used as a wrapping material. It is also advantageous if the printed product used for wrapping is placed in a prominent location and protrudes outward from all other printed products within the collection 15 especially clearly.

Figure 2:
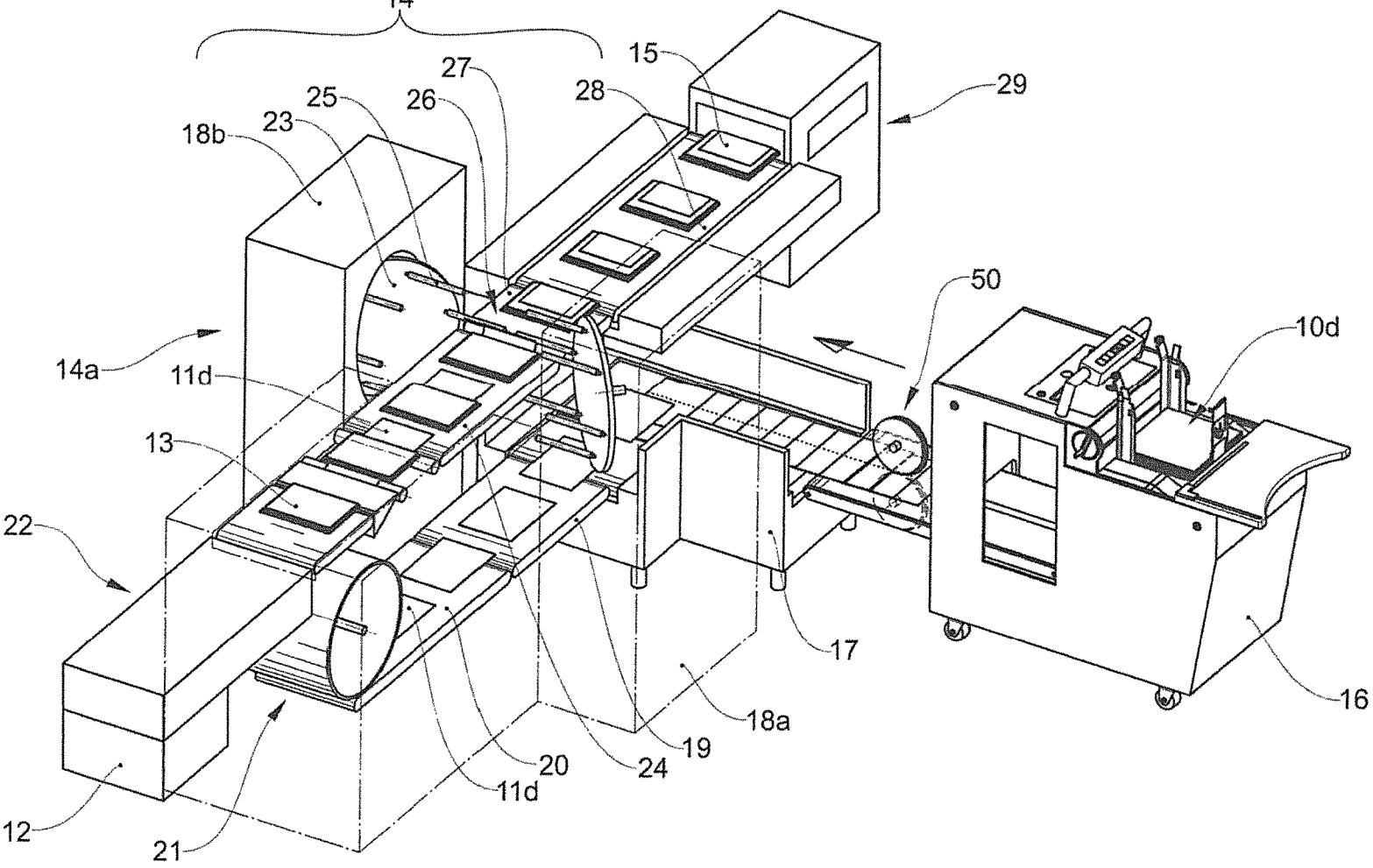
FIG. 2 shows a first embodiment example of the device according to the invention in a perspective view.

An embodiment example of a packing device 14 is shown in perspective view in FIG. 2. The packing device is arranged between the end of a collecting device 12 (left edge of FIG. 2) and the inlet region of a conveying device 29 (right edge of FIG. 2) and comprises a plurality of conveyor segments 24, 27, and 28 in a conveying plane, which conveyor segments are arranged one after the other and are equipped with belts. A wide conveying gap 26 is left clear between the conveyor segments 24 and 27, which conveying gap will be revisited further below.

The collecting device 12 outputs the intermediate stacks 13 compiled from the individual printed products by means of a transferring device 22, which intermediate stacks reach the first conveyor segment 24 via the upper section of a conveying segment 21 coming from below. Synchronously with each output intermediate stack 13, a printed product 11*d* serving as a packaging element is conveyed upward by means of the conveying segment 21 from below in such a way that the printed product comes to lie under the associated intermediate stack 13 coming from the collecting device 12 partially, i.e., by means of a section that is at the rear in the conveying direction, while a front section of the printed product 11*d* remains uncovered.

When the unit including the printed product 11*d* lying partially under the intermediate stack 13 and the intermediate stack 13 lying on the printed product 11*d* reaches the conveying gap 26, the uncovered part of the printed product or packaging element 11*d* is caught from both sides by rod-shaped entraining elements 25 of a wrapping device 18*a* or 18*b* that protrude into the conveying gap 26 and move upward in the conveying gap 26 from below, is lifted upward, and is wrapped around the intermediate stack 13 rearward against the conveying direction. After the end of the wrapping process, the collections 15 are conveyed via the conveyor segment 28 to the conveying device 29 and are transferred there.

After the rod-shaped entraining elements 25 of the wrapping devices 18*a,b* have left the region of the conveying gap 26 upward, the rod-shaped entraining elements 25 are led laterally out of the region of the conveyor segments and back down in a closed circuit in order to move back into the region of the conveyor segments there and to be ready for the next lifting of a packaging element 11*d* in the conveying gap 26. For this purpose, a plurality of entraining elements 25 is arranged on each side on a rotary disk 23 arranged at angle to the conveying direction, in such a way that the individual entraining elements 25 are oriented transversely to the conveying direction and maintain this orientation in space without change during the rotation of the rotary disk 23. The rod-shaped entraining elements 25 thus perform a motion that is composed of a rotational motion about an axis of rotation oriented transversely to the conveying direction and an oscillatory linear motion in the direction of the axis of rotation. However, it is also conceivable that the entraining elements are arranged on the rotary disk in such a way that they lie on the lateral surface of a frustum of a cone.

The printed products 11*d* used as a packaging element are individually drawn from the supply stack 10*d* in a laterally transversely arranged feeding apparatus (feeder) 16 and transferred as a shingled stream to a deflecting device 17, which transports the packaging elements or printed products 11*d* individually at a distance via two conveyor segments 19 and 20 to the conveying segment 21, where they are then conveyed upward and are merged ("meshed") in the described manner with the intermediate stacks 13 coming from the collecting device 12. The printed products 11*d* can advantageously be grooved, i.e., provided with a groove in the center, in the shingled stream by a grooving device 50 arranged there, which groove makes the later wrapping in the wrapping device 18*a,b* easier.

While the packaging elements or printed products 11*d* are fed from below and the intermediate stacks 13 come to lie on the printed products accordingly for the system and wrapping device 14*a* shown in FIG. 2, the situation is exactly opposite for the system and wrapping device 14*b* shown in FIG. 3, i.e., the packaging elements or printed products 11*d* are fed from above, laid onto the intermediate stacks 13 from above, and wrapped downward in the conveying gap 26 by means of wrapping devices 18*a,b* that are of the same type but rotate differently. Here also, the intermediate stacks 13 are conveyed from the collecting device 12 to an outlet-side conveying device 29 by means of conveyor segments 30 and 31. The packaging elements or printed products 11*d* in turn come in a shingled stream from a laterally arranged feeding apparatus 16 and are then moved individually and at a distance toward the intermediate stacks downward and at an angle in a deflecting device 17 in parallel with the conveyor segments 30 and 31 and laid onto the intermediate stacks. Here also, a grooving device 50 can advantageously be used.

Figure 3:
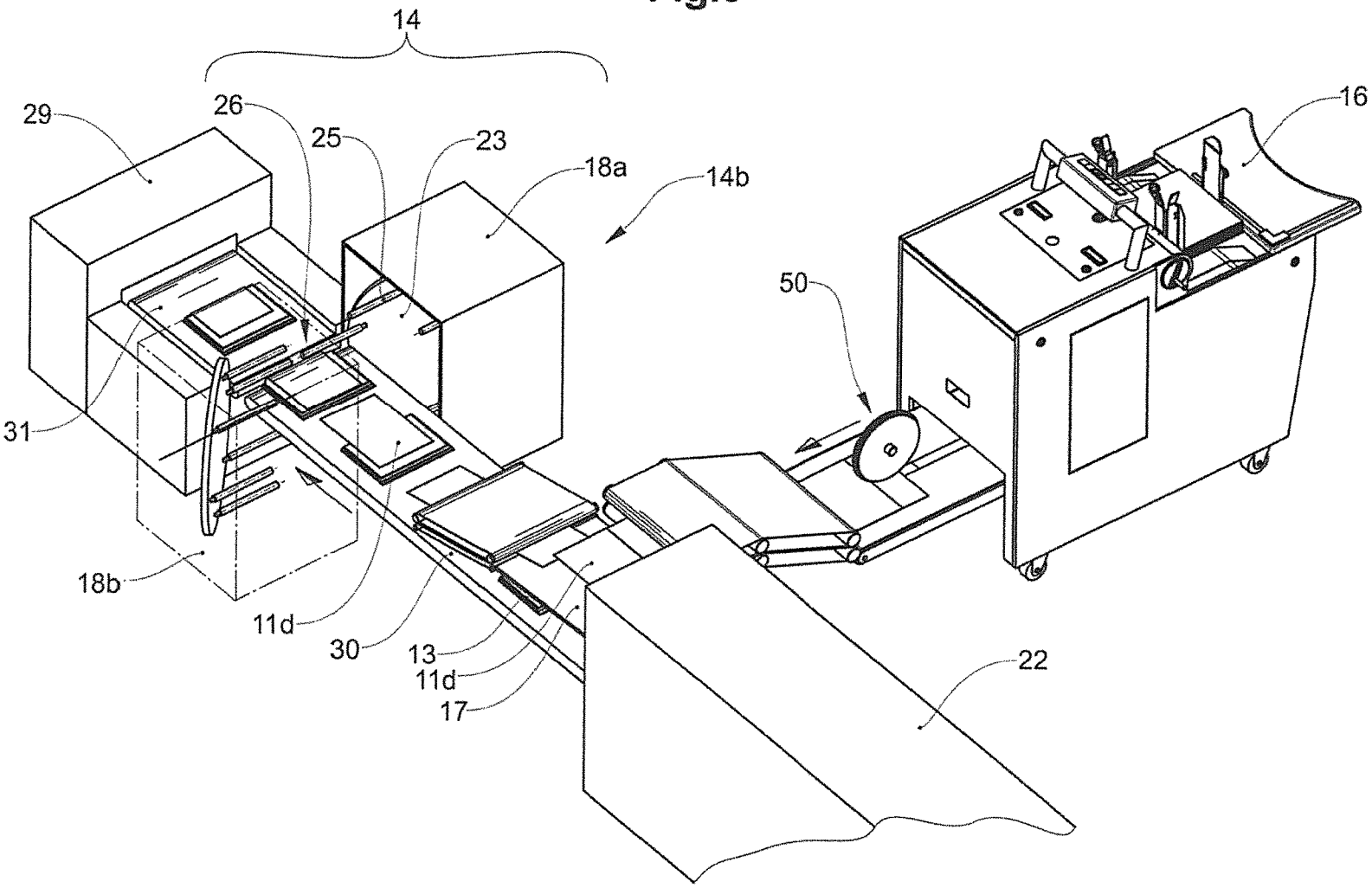
FIG. 3 shows a second embodiment example of the device according to the invention in a perspective view.

In the embodiment examples of FIG. 2 and FIG. 3, circulating rod-shaped entraining elements 25 are used to wrap the packaging elements or printed products 11*d* around an edge of the intermediate stack 13. According to FIG. 1*b*, if some or all printed products 11*a-d* have a fold F or a bond, the printed products having a fold or a bond are laid one on top of the other during the formation of the intermediate stack 13 in such a way that the folds F and the bonds form a common edge K of the intermediate stack 13, and that the intermediate stack 13 is wrapped in the packaging element 11*d* by means of the common edge K. Here, the term "printed products with bonds" refers particularly to printed products that have a connection on a certain side that is effected by adhesive bonding.

There are also other possibilities for wrapping the packaging elements or printed products 11*d* around an edge of the intermediate stack 13. In the embodiment example of FIGS. 4 and 5, brush rollers 34 or 39 arranged in the conveying gap 26 and having corresponding bristles 35 or 40 are used for this purpose. Here, in both cases, the intermediate stack 13 is set onto the packaging elements or printed products 11*d* from above and the packaging elements or printed products 11*d* are wrapped upward around the intermediate stack 13, analogously to FIG. 2. The conveying gap 26 is formed between two conveying apparatuses, which consist of conveyor belts 32, 33 or 36, 37 running parallel and convey the units including the intermediate stack 13 and the packaging element or printed product 11*d* between these belts.

Figure 4:
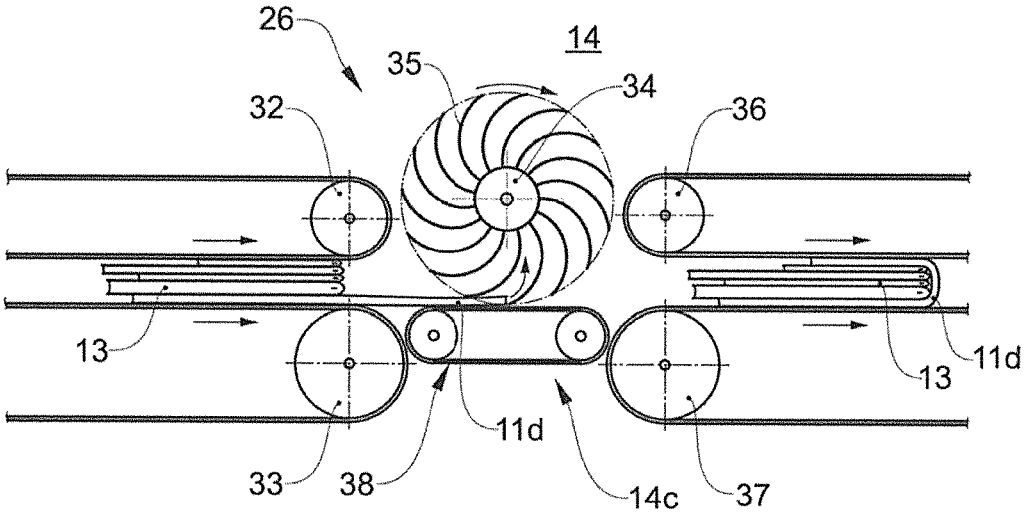
FIG. 4 shows an embodiment example of a wrapping device within the device according to the invention in a schematic side view.
Figure 5:
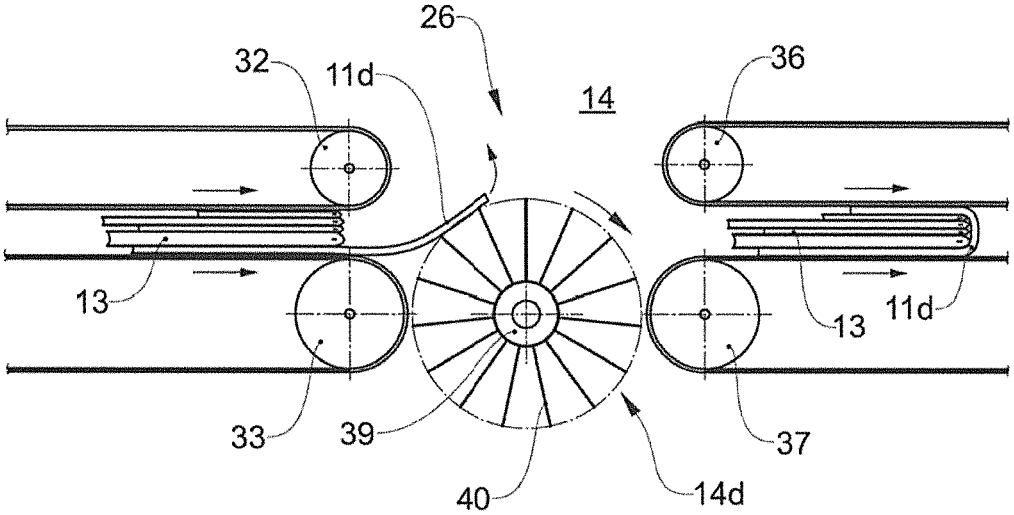
FIG. 5 shows another embodiment example of a wrapping device within the device according to the invention in a schematic side view.

In the example of FIG. 4, in the wrapping device 14*c* there, the bristles 35 of the brush roller 34, which bristles are bent in the direction of rotation, reach under the freely protruding section of the packaging element or printed product 11*d* and bend the freely protruding section upward approximately at a right angle in a first step. In a second step, the part of the packaging element or printed product 11*d* bent upward is then bent back over the intermediate stack 13 when the unit including the intermediate stack 13 and the packaging element or printed product 11*d* bent upward enters the intermediate space between the conveyor belts 36 and 37. In order to avoid a dropping of the free section of the packaging element or printed product 11*d* during the entry into the conveying gap 26, additional conveyor belts 38 can be provided laterally with respect to the brush roller 34. These additional conveyor belts 38 are not necessary if, in the wrapping device 14*d* according to FIG. 5, the free section of the packaging element or printed product 11*d* is wrapped upward by a lower lying brush roller 39 having soft bristles 40 that stand up because of the rotation.

Figure 6:
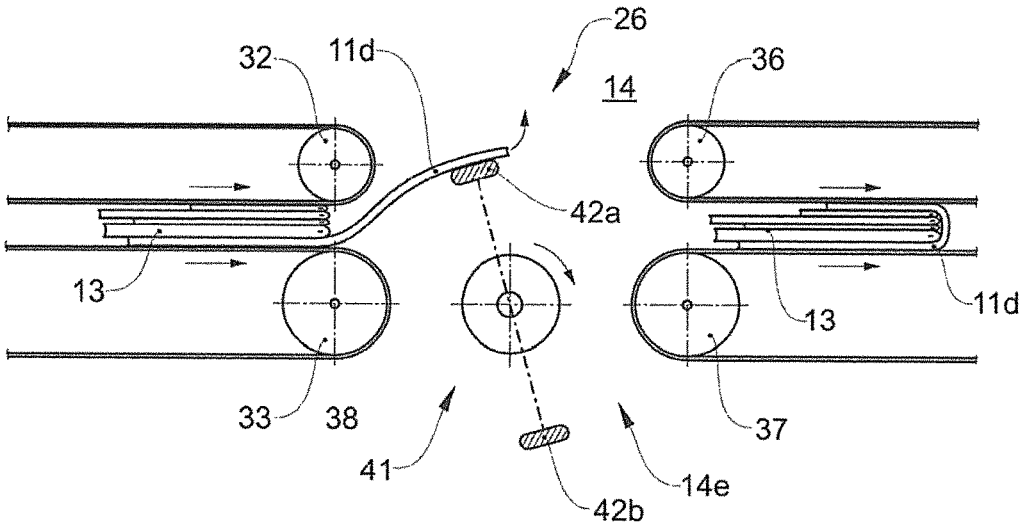
FIG. 6 shows a further embodiment example of a wrapping device within the device according to the invention in a schematic side view.

In the embodiment example of FIG. 6, a rotating double arm 41 having two opposite arms 42*a* and 42*b* is used instead of brush rollers in the wrapping device 14*e* there, which arms always exchange their position when one of the intermediate stacks has passed through the conveying gap 26. In the position of the double arm 41 shown in FIG. 6, the double arm 41 is presently holding the printed product 11*d* provided for packing by means of its upper arm 42*a* at such a height that the intermediate stack 13 conveyed to the right can be moved under the upper arm 42*a* (which is standing still or moving only slowly). The printed product 11*d* wraps around the intermediate stack at the top and the intermediate stack enters between the conveyor belts 36 and 37 together with the wrapped printed product 11*d*. After the stack has moved through, the double arm rotates in the clockwise direction to such an extent and so quickly that the other arm 42*b* henceforth assumes the position of the arm 42*a* shown in FIG. 6 and supports the lower printed product of the next intermediate stack. This process is continually repeated.

Figure 7:
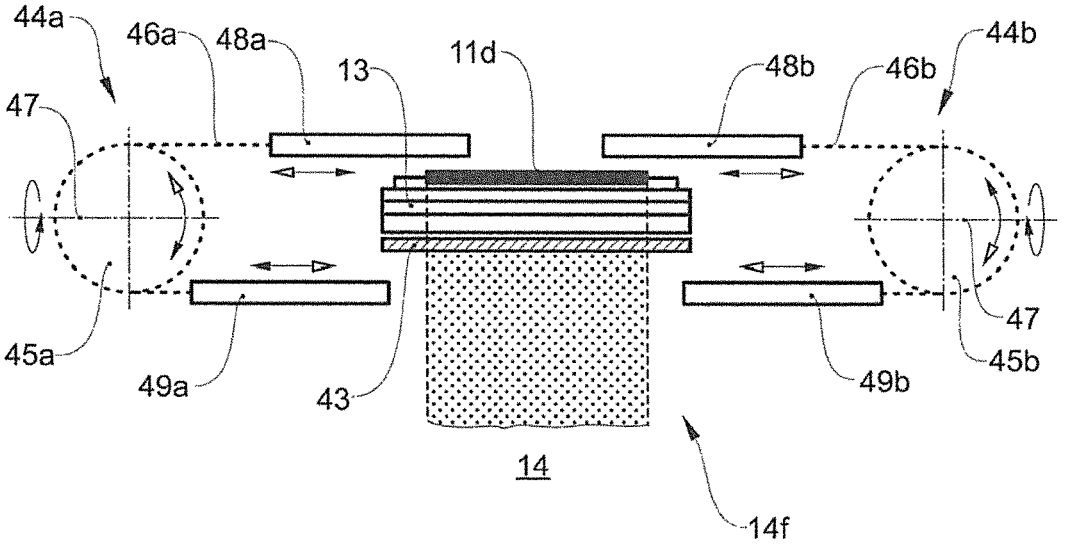
FIG. 7 shows another embodiment example of a wrapping device within the device according to the invention in a schematic view against the conveying direction.

The mechanism shown in FIG. 7 acts similarly to the action in FIGS. 2 and 3 by means of its rod-shaped entraining elements 48*a,b* and 49*a,b*. The entraining elements 48*a,b* and 49*a,b* are connected to each other in pairs by means of flexible but fixed-length connecting elements 46*a,b* over deflecting wheels 45*a,b* that can be moved back and forth, wherein the entire assembly including the deflecting wheel 45*a,b* and the entraining element pair on both sides of the conveyor belt 43 can be rotated about an axis of rotation 47.

The entraining elements 48*a,b*, 49*a,b* thus can be moved through the conveying gap 26 about the axis of rotation 47 oriented transversely to the conveying direction and perform an oscillatory motion parallel to this axis of rotation at the same time as the rotational motion about this axis of rotation 47, which oscillatory motion occurs between a first extreme position, in which the entraining elements 48*a,b*, 49*a,b* protrude into the conveying path of the unit including the intermediate stack 13 and the packaging element 11*d*, and a second extreme position, in which the entraining elements 48*a,b*, 49*a,b* are outside of the conveying path of the unit including the intermediate stack 13 and the packaging element 11*d*. The motion of the entraining elements 48*a,b*, 49*a,b* therefore is analogous to the motion of the entraining elements 25 on the rotary disks 23 in FIGS. 2 and 3. Also, the arrangement of the mechanism on both sides of the conveying path is mirror symmetric in the same way as in the wrapping devices 18*a,b* from FIGS. 2 and 3.

I claim:

1. A method for producing collections from a plurality of N (N=2, 3, 4, . . . ) different printed products having a bond or a fold, which collections each comprise a stack of printed products, which stack is packed in a packaging element wrapped around the stack, comprising the following steps:

providing the N printed products having the bond or the fold;

forming an intermediate stack from N−x (x=1, 2, 3, . . . ) of the N printed products having the bond or the fold;

providing the x remaining printed products having the bond or the fold as a packaging element;

wrapping the intermediate stack in the packaging element;

wherein the packaging element is laid onto a substratum, and the intermediate stack is laid onto the packaging element in such a way that only a partial area of the packaging element is covered by the intermediate stack, and that the packaging element is wrapped around the intermediate stack by a remaining area of the packaging element not being covered by the intermediate stack; and wherein, in order to wrap the remaining area of the packaging element not being covered by the intermediate stack around the intermediate stack, the complete remaining area of the packaging element is bent upward approximately at a right angle in a first step and the part of the packaging element bent upward is bent hack over the intermediate stack in a second step.

2. The method according to claim 1, wherein x=1.

3. The method according to claim 1, wherein a unit including the intermediate stack and the packaging element is moved through a wrapping device in order to bend the packaging element.

4. The method according to claim 3, wherein movable elements, which are rotated about an axis of rotation oriented transversely to the movement direction of the unit including the intermediate stack and the packaging element, are used to bend the packaging element in the wrapping device.

5. The method according to claim 3, wherein, after the packaging element has been bent, the bent part of the packaging element is bent back and laid against the intermediate stack by laying the unit including the intermediate stack and the packaging element onto a conveyor belt.

6. The method according to claim 1, wherein some of the printed products have a fold (F) or a bond, that the printed products having a fold (F) or bond are laid one on top of the other during the formation of the intermediate stack in such a way that the folds (F) or bonds form a common edge (K) of the intermediate stack, and that the intermediate stack (13) is wrapped in the packaging element by means of the common edge (K).

7. The method according to claim 1, wherein the packaging elements are grooved before the intermediate stack is wrapped.

8. A device for performing the method according to claim 1, wherein the device comprises a packing device, in which the packaging element lying partially below the intermediate stack is wrapped around the intermediate stack.

9. The device according to claim 8, wherein the packing device comprises a wrapping device and means for moving a unit including the intermediate stack and the packaging element through the wrapping device.

10. The device according to claim 9, wherein the means for moving the unit including the intermediate stack and the packaging element through comprise conveyor segments or conveyor belts lying in a plane, between which a conveying gap is left clear.

11. The device according to claim 10, wherein the wrapping device comprises movable elements, which reach into a conveying path of the unit including the intermediate stack and the packaging element in the conveying gap.

12. The device according to claim 11, wherein the movable elements comprise a brush roller including bristles, which brush roller is arranged in the conveying gap and can be rotated about an axis of rotation oriented transversely to the conveying direction.

13. The device according to claim 11, wherein the movable elements comprise rod-shaped entraining elements, which can be moved through the conveying gap while rotating about a specified axis of rotation.

14. The device according to claim 13, wherein the axis of rotation is oriented transversely to the conveying direction and the entraining elements can perform an oscillatory motion parallel to this axis of rotation at the same time as the rotational motion about this axis of rotation, which oscillatory motion occurs between a first extreme position, in which the entraining elements protrude into the conveying path of the unit including the intermediate stack and the packaging element, and a second extreme position, in which the entraining elements are outside of the conveying path of the unit including the intermediate stack and the packaging element.

15. The device according to claim 14, wherein the rod-shaped entraining elements are arranged on opposite sides of the conveying path of the unit including the intermediate stack and the packaging element in a mirror-symmetric arrangement.

16. The device according to claim 15, wherein, in order to produce simultaneous rotational motion and oscillatory motion, the rod-shaped entraining elements are fastened in a concentric circle to rotary disks arranged at an angle.

17. The device according to claim 15, wherein the simultaneous rotational motion and oscillatory motion of the entraining elements are produced by separate mechanical means.

18. The device according to claim 8, wherein means for feeding the packaging elements to the wrapping device are provided.

19. The device according to claim 18, wherein the feeding means comprise a grooving device for grooving the fed packaging elements.

20. A method for producing collections from a plurality of N (N=2, 3, 4, . . . ) different printed products, which collections each comprise a stack of printed products, which stack is packed in a packaging element wrapped around the stack, comprising the following steps:

providing the N printed products;

forming an intermediate stack from N−x (x=1, 2, 3, . . . ) of the N printed products;

providing the x remaining printed products as a packaging element;

bending the packaging element via movable elements, which are rotated about an axis of rotation oriented transversely to the movement direction of the unit including the intermediate stack and the packaging element; and wrapping the intermediate stack in the packaging element.

21. A device for performing a method for producing collections from a plurality of N (N=2, 3, 4, . . . ) different printed products, the collections each comprising a stack of printed products, which stack is packed in a packaging element wrapped around the stack, the method comprising the following steps:

providing the N printed products;

forming an intermediate stack from N−x (x=1, 2, 3, . . . ) of the N printed products;

providing the x remaining printed products as a packaging element; and wrapping the intermediate stack in the packaging element, wherein the device comprises:

a packing device, in which the packaging element is wrapped around the intermediate stack;

conveyor segments or conveyor belts lying in a plane, between which a conveying gap is provided, wherein the conveyor segments or conveyor belts convey a unit including the intermediate stack and the packaging element; and a wrapping device comprising movable elements extending into a conveying path of the unit via the conveying gap.

* * * * *